US009579711B2

(12) United States Patent
McBain et al.

(10) Patent No.: US 9,579,711 B2
(45) Date of Patent: Feb. 28, 2017

(54) FORGING APPARATUS

(71) Applicant: ROLLS-ROYCE PLC, London (GB)

(72) Inventors: John McBain, Glasgow (GB); Paul Giblin, Lanarkshire (GB)

(73) Assignee: ROLLS-ROYCE plc, London (GB)

( * ) Notice: Subject to any disclaimer, the term of this patent is extended or adjusted under 35 U.S.C. 154(b) by 227 days.

(21) Appl. No.: 14/093,261

(22) Filed: Nov. 29, 2013

(65) Prior Publication Data

US 2014/0165688 A1 Jun. 19, 2014

(30) Foreign Application Priority Data

Dec. 19, 2012 (GB) ..... 1222904.3

(51) Int. Cl.

| | |
|---|---|
| ***B21J 5/02*** | (2006.01) |
| ***B21J 9/02*** | (2006.01) |
| ***B21J 13/02*** | (2006.01) |
| ***B21K 3/04*** | (2006.01) |

(52) U.S. Cl.

CPC ..... *B21J 9/027* (2013.01); *B21J 5/02* (2013.01); *B21J 5/025* (2013.01); *B21J 9/02* (2013.01); *B21J 13/025* (2013.01); *B21K 3/04* (2013.01)

(58) Field of Classification Search

CPC ..... B21J 5/02; B21J 5/025; B21J 9/02; B21J 9/027; B21J 13/025; B21K 3/04

USPC ..... 72/352, 353.2, 355.2, 355.6, 358, 359, 72/273

See application file for complete search history.

(56) References Cited

U.S. PATENT DOCUMENTS

| | | | | |
|---|---|---|---|---|
| 3,382,692 | A * | 5/1968 | Bodine | 72/60 |
| 4,055,975 | A * | 11/1977 | Serfozo et al. | 72/42 |
| 4,291,566 | A * | 9/1981 | Dinsdale | 72/342.94 |
| 4,425,774 | A | 1/1984 | Shinozaki et al. | |

FOREIGN PATENT DOCUMENTS

| | | |
|---|---|---|
| DE | 1 257 539 | 12/1967 |
| EP | 1 044 741 A2 | 10/2000 |
| GB | 720113 | 12/1954 |
| GB | 730062 | 5/1955 |

OTHER PUBLICATIONS

Search Report issued in European Patent Application No. 13 00 5592 dated May 16, 2014.

Feb. 25, 2013 Search Report issued in British Application No. GB 1222904.3.

* cited by examiner

*Primary Examiner* — David B Jones

(74) *Attorney, Agent, or Firm* — Oliff PLC

(57) ABSTRACT

A forging apparatus and method is disclosed in which a punch 260 is held in a press 210, 220 and propelled towards a billet 250 by a ram 240. The ram 240 is separate from the punch 260. Thus, any axial misalignment between the ram 240 and the press 210, 220 in which the billet is held, for example due to the extremely high loads involved, has no affect on the direction and position of the impact force the punch 260 transmits to the billet 250. This helps to prevent unwanted forces and bending moments in the punch 260, thereby preventing breakage of the punch 260.

12 Claims, 3 Drawing Sheets

FORGING APPARATUS

CROSS-REFERENCE TO RELATED APPLICATIONS

This application is based upon and claims the benefit of priority from British Patent Application Number 1222904.3 filed 19 Dec. 2012, the entire contents of which are incorporated by reference.

BACKGROUND OF THE INVENTION

1. Field of the Invention

The present invention relates to an apparatus and method for forging a shaped component, in particular a shaped component of a gas turbine engine.

Forging is used in a variety of metalworking operations in order to produce shaped components. Typically, a hammer or ram is used to provide a compressive force to a billet of metal (which may be heated) in order to deform the metal into the shape of a die.

2. Description of the Related Art

Various different types of forging process have been developed to suit the desired properties of the shaped component, for example in terms of size, shape, material properties and required throughput.

In one particular type of forging, which may be referred to as a horizontal split die forging press or as a multiforge, a billet of heated metal is positioned in a forging press, and then a ram is used to strike the billet so as to provide a, typically horizontal, force to press the metal billet into a die. In this way, the shape of the billet deforms so as to take on the shape of the die. Such an arrangement may be suitable for automation, for example using an reciprocating ram and an automated machine for positioning the billet and removing the shaped part from the die.

An example of such a forging apparatus 100, hereinafter referred to as a forging apparatus 100, is shown in FIG. 1. The forging apparatus 100 comprises an upper press 110 and a lower press 120. In operation, the upper press 110 and the lower press 120 move together and are held together by a grip load, which may be on the order of hundreds of tonnes. A die piece 130 is positioned between the upper press 110 and lower press 120. The die piece 130 holds a billet of metal 150 when the presses 110, 120 are moved together under the grip load.

In the forging operation, a punch 140 is propelled towards the billet 150 in a direction shown by arrow A in FIG. 1. The punch 140 comprises a ram portion 144 and a striking portion 142. The striking portion 142 strikes the billet 150, which may be pre-heated, and forces the metal in the billet 150 to move in the general direction of arrow A into a shaped die 132, which is a part of the die piece 130. In this way, the shape of the billet 150 changes to correspond to the shape of the shaped portion 132.

As illustrated in FIG. 1, the operation involves propelling the punch 140 in the direction of arrow A along the longitudinal axis X-X of the punch 140, which is intended to correspond to the longitudinal axis of the billet 150 (as shown by the single dashed line X-X in FIG. 1). However, the longitudinal axes of the billet 150 and the punch 140 may not always be precisely aligned when the punch 140 strikes the billet 150. For example, the longitudinal axis of a particular billet 150 may be offset by a distance 1 relative to the longitudinal axis of the billet 150, illustrated as the dashed line Y-Y in FIG. 1.

The offset in the longitudinal axes of the billet 150 and the punch 140 may be a result of a various different effects. For example, one or both of the presses 110, 120 may deflect slightly different amounts from one forging operation to another under the very large gripping loads involved in the forging operation, for example due to small variations in the alignment, the billets and/or due to component wear.

The result of this variability in the alignment of the longitudinal axes is that a very large bending moment may be generated in the punch when it strikes the billet 150, at the interface 145 between the ram portion 144 and the striking portion 142. As illustrated by the zig-zag line in FIG. 1, this has been known to damage the punch 140, with the striking portion 142 breaking away from the ram portion 144. This problem may be exacerbated by the requirement to use hardened material for the punch 140, because this hardened material may also be brittle and thus susceptible to breakage. The damaged punch may cause further damage to other components of the forging apparatus 100. This undesirable affect may be particularly significant if the forging process is automated, because the whole process would need to be interrupted to repair the damage.

OBJECTS AND SUMMARY OF THE INVENTION

Aspects of the invention address problems including those outlined above.

According to an aspect, there is provided a forging apparatus for producing a shaped component from a billet (which may be referred to as a slug or an ingot). The forging apparatus comprises an upper press and a lower press, the upper and lower presses, when moved together, defining a first cavity for receiving the billet a second cavity defining the shape of the shaped component, the first and second cavities being in communication with each other. The forging apparatus also comprise a punch configured to strike the billet so as to force the billet from the first cavity to the second cavity; and a ram configured to strike the punch. The ram and the punch are separate from each other. The punch may be said to move along a forging direction to force the billet from the first cavity to the second cavity.

According to an aspect, there is provided a method of forging a shaped component. The method may comprise using a forging apparatus as disclosed herein in relation to the invention. The method comprises positioning a billet between an upper press and a lower press of a forging machine; positioning a punch between the upper and lower presses of the forging machine, the billet and punch being aligned in a forging direction; and striking the punch with a separate ram. The ram strikes the punch such that the punch moves along the forging direction and forces the billet into a cavity formed by the upper and lower presses. The cavity defines the shape of the shaped component.

Such a forging apparatus and/or method may have improved reliability, for example improved tolerance to misalignment between the ram and the billet during forging.

A gripping load may be applied through the upper and lower presses. The gripping load may be perpendicular to the forging direction.

The first cavity of the forging apparatus may be referred to as a die, for example a closed die. The first cavity and the second cavity may be part of the same physical component, or formed by the same physical components, which may be referred to as die pieces. A part of the first cavity and a part of the second cavity may be formed by the lower press (or one or more components attached to the lower press), and complimentary parts of the first and second cavities may be formed by the upper press (or one or more components attached to the upper press).

The forging apparatus may comprise a punch holder arranged to hold the punch in position between the upper press and the lower press. The punch holder may take any suitable form, for example it may be a third cavity defined by the upper and lower presses when they moved together. The punch holder may comprise a first part attached to (or integral with) the upper punch, and a second part attached to (or integral with) the lower punch.

The centrelines of the first cavity and the punch holder of the forging apparatus may be aligned. In this regard, the centrelines may be co-linear with the longitudinal axes of the first cavity and punch holder, and thus also the longitudinal axes of the billet (when inserted into the first cavity) and the punch (when inserted into the punch holder).

The punch may comprise a first part which, in use, is struck by the ram, and a second part which, in use, strikes the billet. The first part may be referred to as a header punch and the second part may be referred to as an extrusion punch. The header punch and the extrusion punch may be integral parts of the punch.

The header punch has a cross sectional area perpendicular to the direction in which it is struck by the ram and the extrusion punch has a cross sectional area perpendicular to the direction in which it strikes the billet. The cross sectional area of the header punch may be greater than the cross sectional area of the extrusion punch.

The punch may comprise an impact portion. The ram may comprise a striking portion. The striking portion may be configured to strike the impact portion in use. For example, the impact portion may comprise an impact surface that is configured to be struck by a corresponding striking surface of the ram.

The upper and lower presses may be configured to be moveable relative to each other in a first direction. The ram may be configured to strike the punch in a second direction. The first and second directions may be perpendicular to each other. In this way, the upper and lower presses may be configured to provide a clamping force to the billet that is perpendicular and/or independent of the striking force provided by the ram.

The first cavity and the second cavity of the forging apparatus may be offset from each other in a direction that is aligned with the second direction. The striking force provided by the ram may be collinear with the offset from the first cavity to the second cavity.

The forging apparatus may be configured for use in the manufacture of any suitable shape, for example an aerofoil, which may be, for example, for a gas turbine engine. Thus, for example, the first cavity may define an aerofoil shape. It will be appreciated that further processing, such as finishing, may be required before the final shape (for example the final aerofoil shape) is defined.

According to an aspect, there is provided a shaped component manufactured at least in part using the forging apparatus and/or method as described above and elsewhere herein in relation to the invention.

BRIEF DESCRIPTION OF THE DRAWINGS

For a better understanding of the present disclosure, reference will now be made, by way of non-limitative example only, to the accompanying drawings, in which.

DETAILED DESCRIPTION OF THE PREFERRED EMBODIMENTS

Figure 1:
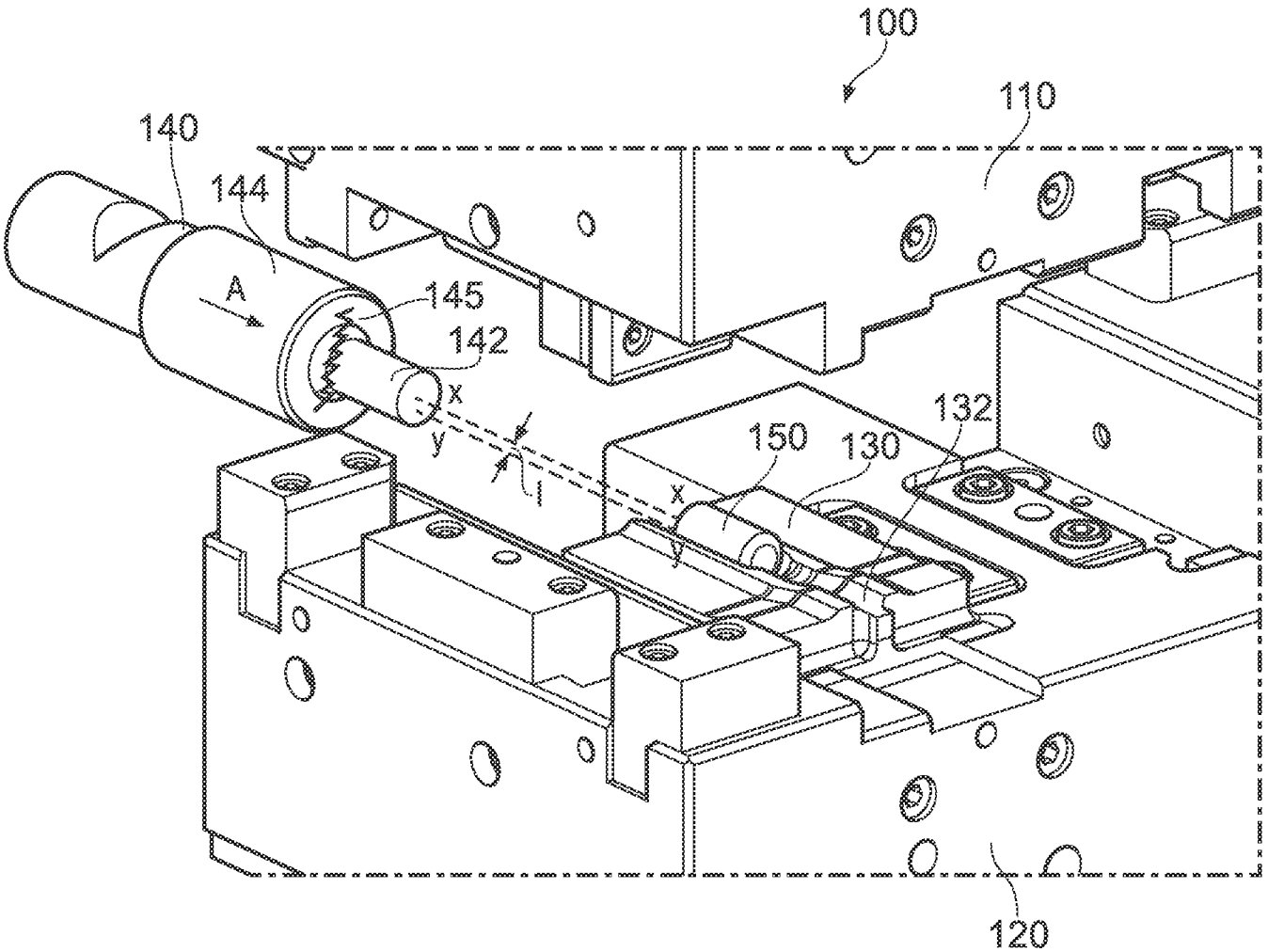
FIG. 1 Related Art
FIG. 1 shows a forging apparatus.

The operation of an example of a forging apparatus 100 has been described above in relation to FIG. 1. As explained above, a problem of the striking portion 142 breaking off from the rest of the punch 140 exists with the FIG. 1 arrangement. This may occur if, for example, there is variation in the position of the dies 110, 120, and thus the billet 150, between forging operations.

Figure 2:
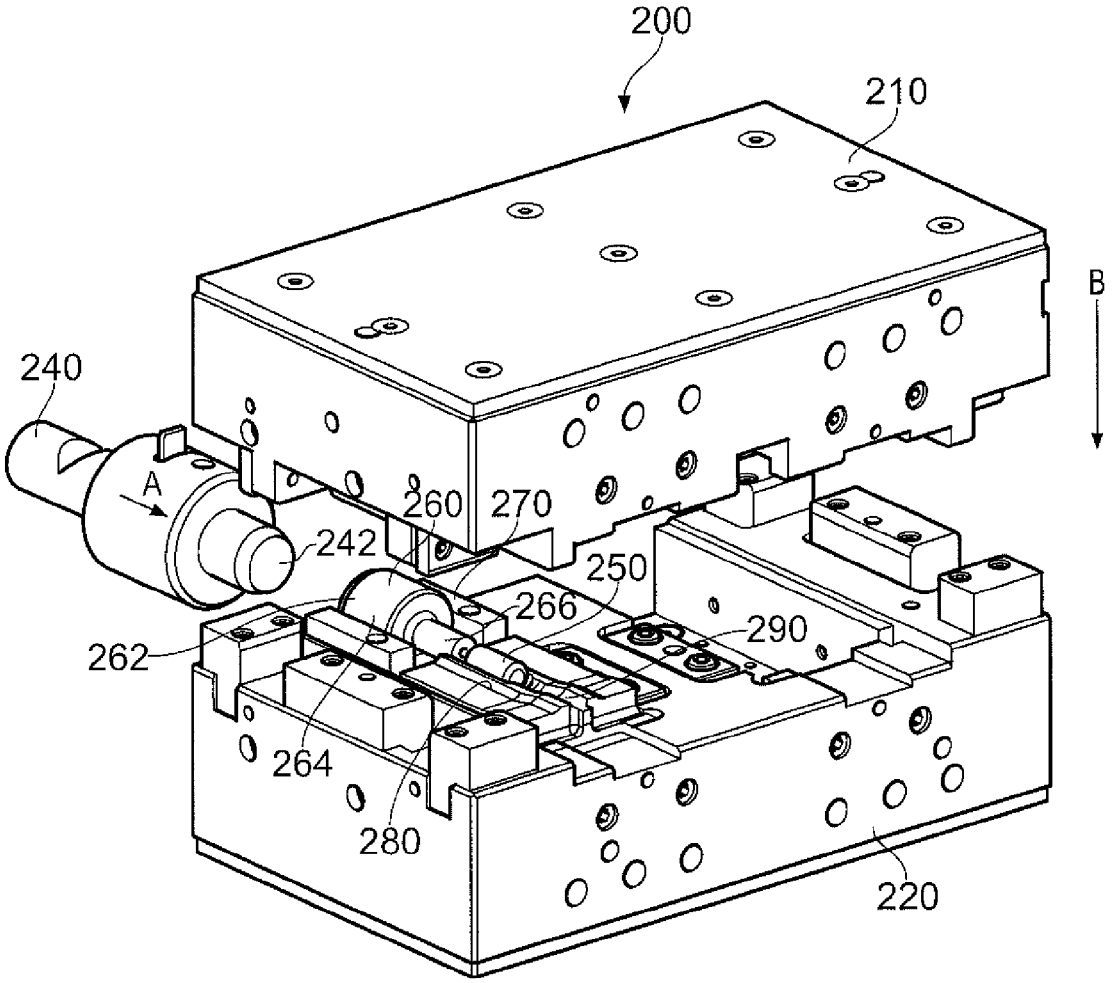
FIG. 2 shows a forging apparatus according to an aspect of the invention.

FIG. 2 shows a forging apparatus 200 according to an aspect of the invention. The forging apparatus 200 has an upper press 210 and a lower press 220. The upper press 210 and the lower press 220 are shown spaced apart, but during use they move together, such that the upper press 210 moves in the direction of arrow B relative to the lower press 220, thereby receiving (which, optionally, may include clamping, or holding) a billet 250.

The forging apparatus 200 also comprises a ram 240 and a separate punch 260. The punch 260 is held in a punch holder 270, which may be defined by the upper and lower presses 210, 220, as in the FIG. 2 example.

In operation, the ram 240 is propelled towards the punch 260 using a suitable motive force in the direction of arrow A, which may be referred to as the forging direction. As shown in the FIG. 2 example, the direction of arrow A may be perpendicular to the direction of arrow B. The direction of arrow A may be substantially horizontal, for example.

The ram 240 has a striking portion 242 that strikes an impact portion 262 (which may be part of a header portion 264) of the punch 260. This causes the punch 260 to be propelled in the forging direction towards the billet 250. In turn, this causes the punch 260 (for example an extrusion punch portion 266 of the punch 260) to strike the billet 250, thereby forcing it from a first cavity 280 in which it is shown in FIG. 2, into a second cavity 290. The second cavity 290 may have the shape of the shaped component that is desired to be output from the forging apparatus 200. This may be any suitable shape, for example an aerofoil shape.

The first and second cavities 280, 290 may be offset from each other in the same direction as the forging direction A, as shown in the FIG. 2 example. Also as illustrated in FIG. 2, the first and/or second cavities may be formed by the upper and lower presses 210, 220, for example when the upper and lower presses 210, 220 are moved together. For example, the upper and lower presses 210, 220 may have respective die portions that come together to form the first and/or second cavities 280, 290. Such die portions may be integral parts of the upper and lower presses 210, 220, or may be removable/replaceable parts that are fixed to the respective upper and lower press 210, 220.

The punch 260 and the billet 250 are both placed and held between the upper press 210 and the lower press 220 during forging. This means that their relative position, or at least the relative position of their longitudinal axes, is defined by the same piece of apparatus (i.e. the presses 210, 220), and thus cannot vary between forging operations. This arrangement ensures that the punch 260 always strikes the billet 250 in the same direction and at the same position. As such, regardless of any variability in alignment of the punch 260 and the ram 240 (and thus of the billet 250 and the ram 240) no unknown or variable force or bending moment is passed into the punch 260, and so it is not susceptible to breakage.

Figure 3:
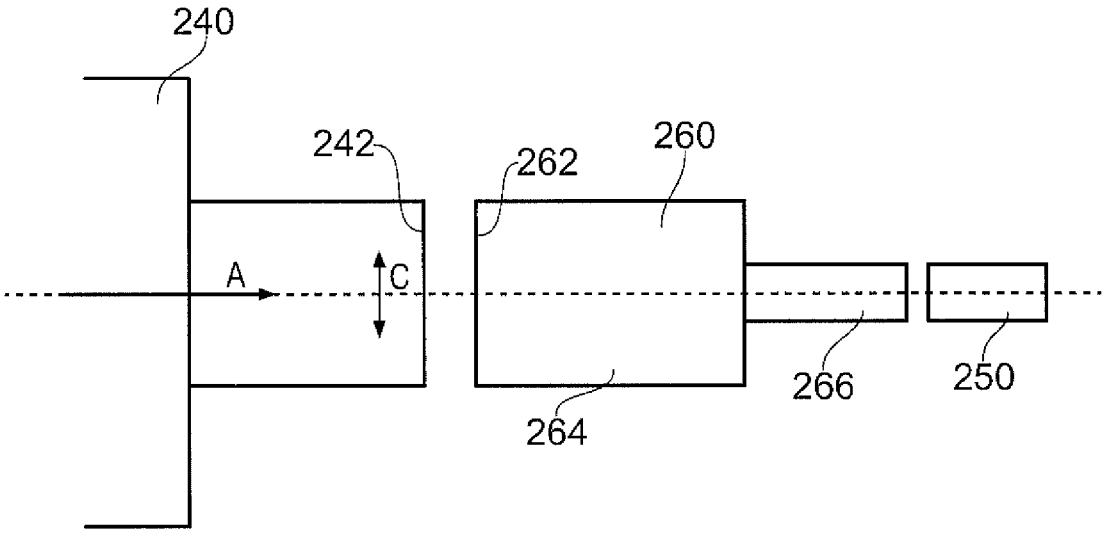
FIG. 3 shows a schematic of a cross-section through a ram, punch and billet of a forging apparatus according to an aspect of the invention.

FIG. 3 shows a schematic of a scenario in which the centrelines, or longitudinal axes, of the ram 240, punch 260, and billet 250 of the FIG. 2 example are all aligned. In this situation, when the ram 240 is propelled towards the punch 260 in the direction of arrow A, the force path is directly through the punch 260 and billet 250 in the forging direction of arrow A, thereby providing a forging force to the billet without any unwanted forces or bending moments in the punch 260.

However, as noted herein, the precise position of upper and lower presses 210, 220 may vary slightly between forging operations and/or over time, for example due to the extremely high loads involved. This may result in the ram 240 moving relative to the punch 260 (and thus the billet 250) in a direction C that is substantially perpendicular to the forging direction A. This may result in the scenario shown in FIG. 4, in which the longitudinal axis of the ram 240 is offset by a distance 1 with respect to the longitudinal axes of the punch 260 and the billet 250. However, in contrast to the arrangement shown in and described in relation to FIG. 1, the punch 260, and thus the portion 266 of the punch 260 that strikes the billet 250, is still axially aligned with the billet 250. This means that even if the ram 240 strikes the punch 260 along a skewed or offset path, the punch 260 still provides a forging force to the billet 250 that is aligned with the billet 250, for example collinear with the longitudinal axis of the billet 250.

Figure 4:
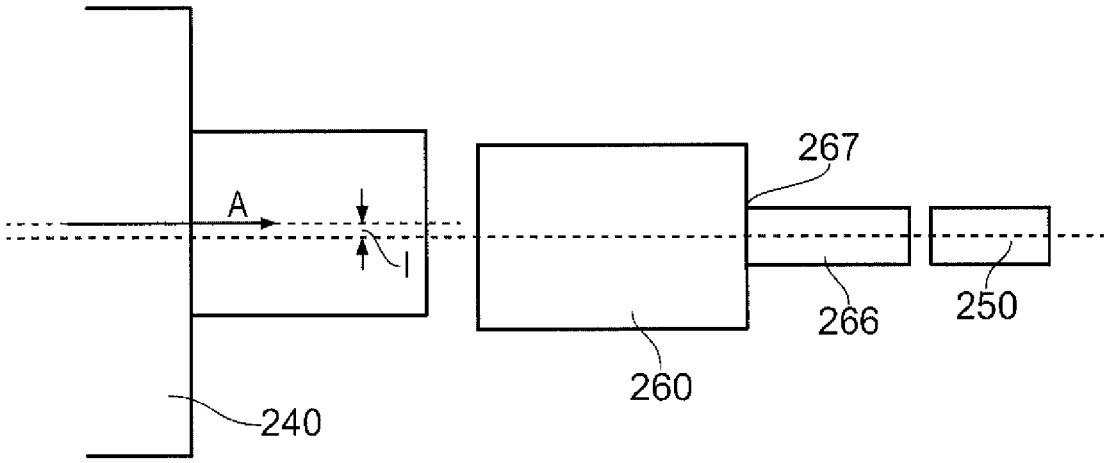
FIG. 4 shoes the ram, punch and billet of FIG. 3, but with the centrelines of the ram and punch offset from each other.

This arrangement shown in FIGS. 2 to 4 prevents damage to the components of the forging apparatus 200 because no unknown or unwanted force or bending moment is passed through the interface 267 between the relatively narrow extrusion portion 266 of the punch 260 and the rest of the punch 260. Any unwanted force or bending moments that result from an unwanted offset of the ram 240, punch 260 and billet 250 passes through the much bulkier and stronger parts of the ram 240 and punch 260 which are not subject to the same dimensional constraints, and thus can be engineered to resist such unwanted forces/bending moments.

It will be appreciated that the forging apparatus 200 described and claimed herein may be a part of a larger apparatus and/or process. For example, the shaped component generated after the billet 250 has been forged by being forced into the second cavity (or die) 290 may required further processing, such as finishing and/or further shaping in order to become a finished part. By way of further example, the billet 250 may be heated before being transferred to the first cavity 280. The various processes may be automated, including the transportation of the billet 250 and/or shaped components between the various processes.

Any component and/or feature described herein may be combined with any other compatible component and/or feature. Furthermore, it will be appreciated that various alternative and/or complimentary arrangements and/or components not explicitly described herein are in accordance with the invention.

We claim:

1. A method of forging a shaped component comprising:

positioning a billet in a first cavity defined by an upper press and a lower press of a forging machine;

positioning a punch between the upper press and the lower press of the forging machine, the billet and the punch being aligned in a forging direction and striking the punch with a separate ram, such that the punch moves along the forging direction (A) and forces the billet into a second cavity formed by the upper press and the lower press, the second cavity defining the shape of the shaped component, the first cavity being separate from the second cavity and the first cavity having a different shape than the second cavity.

2. The method of forging a shaped component according to claim 1, further comprising applying a gripping load to the billet through the upper press and the lower press, the gripping load being perpendicular to the forging direction.

3. The method of forging a shaped component according to claim 1, wherein the second cavity defines an aerofoil shape.

4. A shaped component manufactured using a process comprising the method of claim 1.

5. The method of forging a shaped component according to claim 1, further comprising holding the punch in a position between the upper press and the lower press using a punch holder.

6. The method of forging a shaped component according to claim 5, wherein the punch holder is a third cavity defined by the upper press and the lower press when they are in contact.

7. The method of forging a shaped component according to claim 5, wherein the first cavity and the punch holder have centrelines that are aligned.

8. The method of forging a shaped component according to claim 1, further comprising striking a header punch portion of the punch with the ram, which causes an extrusion punch portion of the punch to strike the billet.

9. The method of forging a shaped component according to claim 8, wherein the header punch has a cross sectional area perpendicular to the direction in which the ram strikes the header punch, and the extrusion punch has a cross sectional area perpendicular to the direction in which the extrusion punch strikes the billet, the cross sectional area of the header punch being greater than the cross sectional area of the extrusion punch.

10. The method of forging a shaped component according to claim 1, wherein:

the punch includes an impact portion;

the ram includes a striking portion; and the method further comprises striking the impact portion of the punch with the striking portion of the ram.

11. The method of forging a shaped component according to claim 1, further comprising:

moving the upper press and the lower press relative to each other in a first direction (B) in order to define the first cavity and the second cavity, and striking the punch with the ram in the forging direction (A), which is perpendicular to the first direction.

12. The method of forging a shaped component according to claim 11, wherein the first cavity and the second cavity are offset from each other in a direction that is aligned with the second direction (B).

* * * * *